US007488059B1

(12) United States Patent
Holland et al.

(10) Patent No.: US 7,488,059 B1
(45) Date of Patent: Feb. 10, 2009

(54) ENCLOSURE FOR INK RESERVOIR BAG

(75) Inventors: Carl W. Holland, Webster, NY (US); William A. Putman, Franklin, TN (US)

(73) Assignee: Nu-Kote International, Inc., Franklin, TN (US)

( * ) Notice: Subject to any disclaimer, the term of this patent is extended or adjusted under 35 U.S.C. 154(b) by 233 days.

(21) Appl. No.: 10/979,844

(22) Filed: Nov. 2, 2004

(51) Int. Cl.
*B41J 2/175* (2006.01)

(52) U.S. Cl. ..... 347/85; 347/86

(58) Field of Classification Search ..... 347/85, 347/86

See application file for complete search history.

(56) References Cited

U.S. PATENT DOCUMENTS 4,619,365 A * 10/1986 Kelly et al. ..... 206/503
5,201,867 A * 4/1993 Morszeck ..... 206/316.2
5,307,091 A * 4/1994 DeCoste, Jr. ..... 347/86
5,400,066 A * 3/1995 Matsumoto et al. ..... 347/86
5,451,995 A * 9/1995 Swanson et al. ..... 347/87
5,469,201 A 11/1995 Erickson et al.
5,745,137 A 4/1998 Scheffelin et al.
6,120,132 A * 9/2000 Coiner et al. ..... 347/49
6,220,702 B1 * 4/2001 Nakamura et al. ..... 347/86
6,270,210 B1 * 8/2001 Yamaguchi et al. ..... 347/86
6,375,316 B1 * 4/2002 Okubo et al. ..... 347/86
6,505,926 B1 * 1/2003 Trafton et al. ..... 347/86
2002/0089576 A1 * 7/2002 Ishizawa et al. ..... 347/86
2004/0056934 A1 * 3/2004 Seino ..... 347/85
2004/0125182 A1 * 7/2004 Akermalm ..... 347/85
2004/0218021 A1 * 11/2004 Ishizawa et al. ..... 347/85

* cited by examiner

*Primary Examiner*—Stephen D Meier
*Assistant Examiner*—Sarah Al-Hashimi
(74) *Attorney, Agent, or Firm*—Fay Sharpe LLP

(57) ABSTRACT

An enclosure for an ink reservoir bag in an ink delivery system for an ink cartridge comprises a tray and a cover for the tray. The tray includes a bottom wall having opposite ends and opposite sides, end walls extending upwardly from said bottom wall at the opposite ends and side walls extending upwardly from the bottom wall along the opposite sides. One of the end walls of the tray has a pair of openings therethrough between the side walls to receive fill and exit ports of the reservoir bag.

6 Claims, 4 Drawing Sheets

ENCLOSURE FOR INK RESERVOIR BAG

BACKGROUND OF THE INVENTION

This invention relates to the art of ink jet printers and, more particularly, to enclosures for ink reservoir bags for supplying ink to an ink cartridge in a continuous ink supply system.

Continuous ink refill systems for disposable ink jet cartridges are of course well known as shown, for example, in U.S. Pat. Nos. 5,469,201 to Erickson, et al. and 5,745,137 to Scheffelin, et al., both of which are incorporated herein by reference for background information. In such systems, basically, a cartridge is connected to an auxiliary supply reservoir by means of a flexible hose or tube and, during operation of the printing system, the tube is open to allow ink to flow from the reservoir to the ink cartridge. During shipping or handling of the ink supply reservoir/cartridge system, when the latter is outside the print machine, and when the system is installed in a printer, it is important to protect the reservoir bag from the application of excessive pressure thereon. In this respect, excessive pressure on the supply bag could cause the associated ink jet cartridge to lose its prime, or could cause leakage in the tubing connection points between the cartridge and reservoir bag. Further, in connection with installation of a system or systems in a printer, it is desired to enable the supply reservoir to be supported on a platform inside the printer so as to stabilize the position of the reservoir relative to the associated cartridge and, in a printer which can accommodate multiple systems, it is desirable to enable stacking of multiple reservoir bags for optimizing the economy of space within the printer.

SUMMARY OF THE INVENTION

In accordance with the present invention, enclosures are provided for the flexible ink supply reservoir bag associated with an ink jet cartridge in a continuous refill system. The enclosures are structured to accommodate an ink reservoir in the form of a bag of flexible plastic material having a structure which provides for containing a desired volume of ink for a given application and for optimizing depletion of the volume of ink from the bag during use such that a minimum amount of ink is left in the bag. Accordingly, the bag structure provides a thin profile and thus a small head height variation over the life of the bag from the full to the empty condition thereof. Preferably, the bag has separate fill and exit ports accessible exteriorly of the enclosure although, as will become apparent hereinafter, the reservoir bag can have a single port accessible exteriorly of the enclosure for connection to the ink cartridge to be supplied by the reservoir. The accessibility to the bag provided by the separate fill and exit ports exposed exteriorly of the enclosure advantageously provides for the selective refilling and reuse of the bag in connection with the same or another ink cartridge.

The enclosure can be of paperboard or plastic construction and, in accordance with one aspect of the invention, is of paperboard construction comprising bottom and cover components formed from structurally identical and dimensionally similar paperboard blanks. In accordance with another aspect of the invention, the enclosure includes a one-piece tray of plastic material and a planar cover therefor. In either instance, the enclosure parts can be securely interconnected so as to preclude tampering with the reservoir bag therein. Moreover, the enclosure structures are sufficiently rigid to prevent excessive pressure on the ink supply bag therein, and the construction promotes the ability to stack a plurality of enclosures in a printer that requires multiple ink supply systems. Further in this respect, the enclosures are of a flat, rectangular shape which promotes stability in the enclosure being supported on a shelf in the printer, and the low profile promotes stacking of the enclosures in a minimum amount of available space. The low profile is also of advantage from the standpoint of aesthetics and, moreover, the flat rectangular shape provides sides having ample space for printing information, instructions and the like.

It is accordingly an outstanding object of the present invention to provide an improved enclosure for receiving and protecting a flexible ink reservoir bag in a continuous ink jet cartridge refill system.

Another object is the provision of an enclosure of the foregoing character which is of a flat rectangular shape promoting the stacking of a plurality of the enclosures in a minimum amount of available space.

A further object is the provision of an enclosure of the foregoing character wherein at least one port and, preferably, two ports for the reservoir bag are accessible exteriorly of the enclosure.

Still another object is the provision of an enclosure of the foregoing character which prevents the application of excessive pressure on an ink reservoir bag therein.

Yet a further object is the provision of an enclosure of the foregoing character which is economical to produce and which can be constructed to be tamper proof with respect to an ink reservoir bag therein.

BRIEF DESCRIPTION OF THE DRAWINGS

The foregoing objects, and others, will in part be obvious and in part pointed out more fully hereinafter in conjunction with the written description of preferred embodiments of the invention shown in the accompanying drawings in which.

DESCRIPTION OF PREFERRED EMBODIMENT

Figure 1:
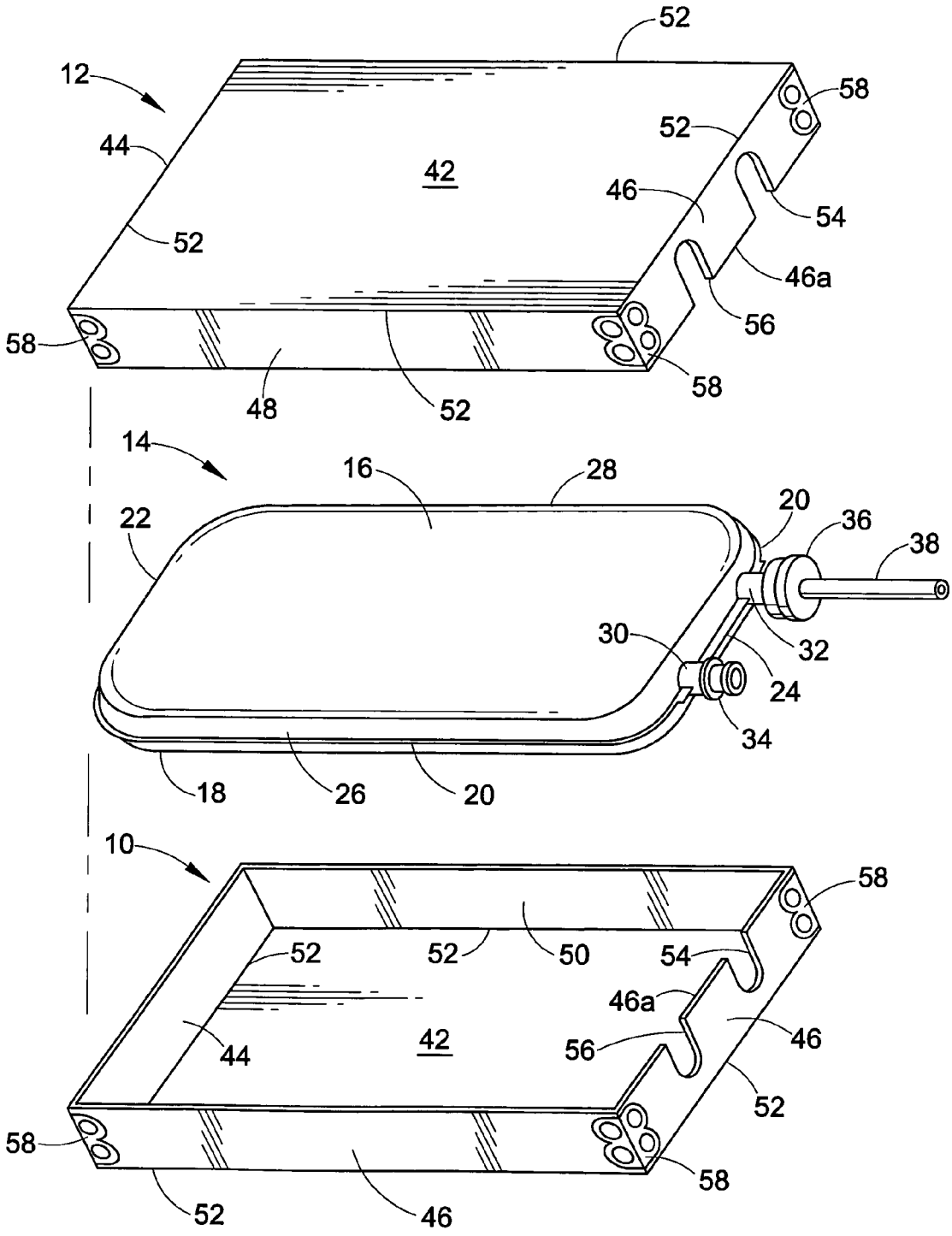
FIG. 1 is an exploded perspective view of an ink supply reservoir bag and bottom and cover components of an enclosure therefor.

Referring now in greater detail to the drawings, wherein the showings are for the purpose of illustrating preferred embodiments of the invention only, and not for the purpose of limiting the invention, FIG. 1 illustrates bottom and cover components 10 and 12, respectively, of an enclosure for an ink reservoir bag 14 of an ink delivery system for the continuous refill of disposable ink jet cartridges. Preferably, ink reservoir bag 14 is defined by a pair of sheets of flexible plastic material 16 and 18 bonded together, such as by heat sealing, to provide a peripheral edge 20 therebetween. Bag 14 is rectangular in contour and, in this respect, has longitudinally opposite ends 22 and 24, laterally opposite sides 26 and 28 therebetween and top and bottom sides respectively defined by plastic sheets 16 and 18. When filled with ink, as depicted in FIG. 1, the bag has a height between the top and bottom sides and, preferably, the length, width and height dimensions provide an aspect ratio which is greater than four. The aspect ratio is the lesser of the length and width dimensions divided by the height dimension. In the embodiment illustrated, bag 14 has a length of 8 inches, a width of 3⅜ inches, and a height of ¾ inch which provides an aspect ratio of 4.5.

Preferably, the reservoir bag has separate inlet and exit ports 30 and 32, respectively, at end 24 of the bag and which extend between the plastic sheets at peripheral edge 20 thereof so as to communicate with the interior of the bag. Fill port 30 provides an injection site for a lure lock component 34 through which the bag can be filled with ink, and a check valve 36 is interposed between exit port 32 and flexible supply tubing 38 by which the reservoir bag is connected to the cartridge in the ink supply system.

Figure 2:
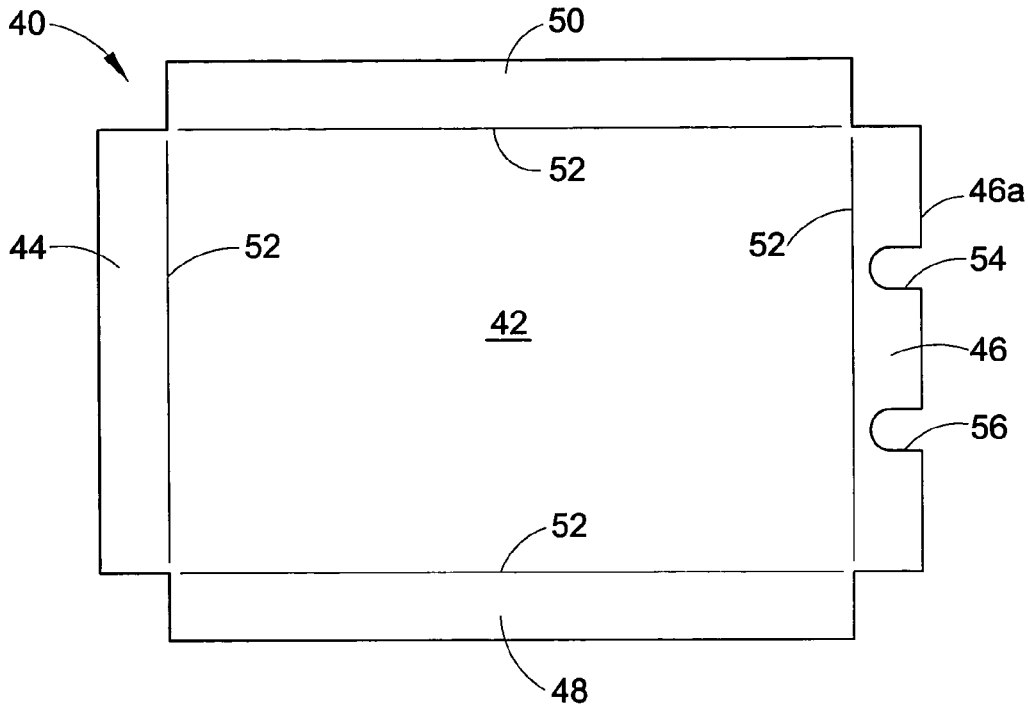
FIG. 2 is a plan view of a paperboard blank from which the enclosure components are constructed.
Figure 3:
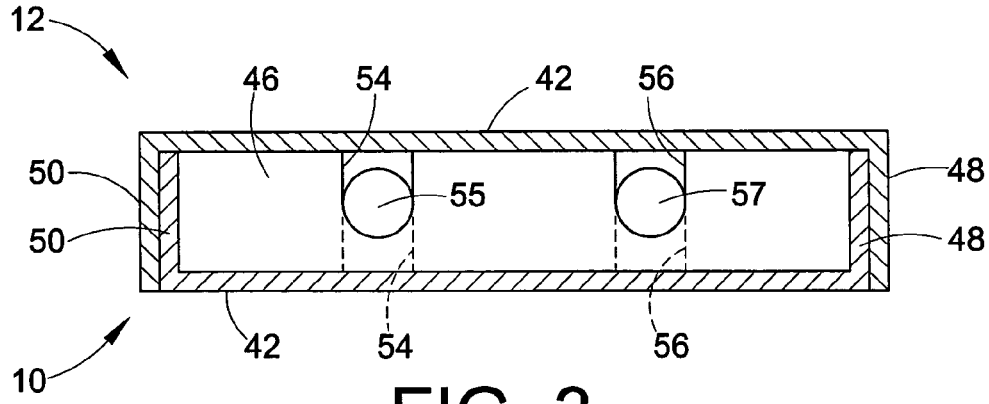
FIG. 3 is a cross-sectional elevation view through the assembled enclosure components shown in FIG. 1.

As mentioned above, the enclosure for bag 14 includes a bottom 10 and a cover 12 each of which is constructed of a suitable cardboard material and from a planar blank of the material, such as blank 40 shown in FIG. 2 of the drawing. More particularly in this respect, blank 40 comprises a rectangular central panel 42, end flaps 42 and 46 at the longitudinally opposite ends of the central panel, and side flaps 48 and 50 at the laterally opposite sides of the central panel. Each of the ends and side flaps is of rectangular contour, extends along the entire length of the corresponding one of the end and side edges of the central panel and is integral with the central panel along a corresponding fold line 52. End flap 46 is provided with a pair of U-shaped slots 54 and 56 spaced apart from one another in the direction between the opposite ends of the flap and each of which opens into the flap from free edge 46*a* thereof. As will be appreciated from FIG. 1, each of the bottom and cover components is constructed by folding flaps 42, 46, 48, and 50 along fold lines 52 to bring the end edges of adjacent ones of the flaps into collinear relationship and then joining the adjacent flaps at the corner therebetween such as by the use of metal corner staples 58. Blank 40 for the bottom and cover component are identical in profile and dimensionally similar, differing dimensionally only as is necessary to provide, as shown in FIG. 3, for one of the bottom and cover components to be received in the other with the side and end flaps fully overlapping one another. When the bottom and cover are assembled, the pairs of U-shaped recesses 54 and 56 cooperatively define a circular opening 55 and 57, respectively, through which fill and exit ports 30 and 32 extend, respectively.

While it is preferred to provide for the bottom and cover to have a pair of openings for receiving fill and exit ports of an ink supply bag, it will be appreciated that the bottom and cover components could be provided with a single pair of aligned U-shaped recesses to accommodate a bag having a single port for connection to tubing leading to the cartridge of the ink supply system. Further, while it is preferred to have the ends and sides of the bottom and cover fully overlap one another so as to optimize structural integrity and the aesthetic value of the enclosure, it will be appreciated that the side and end flaps of the cover could be shorter than those of the bottom. Further, if desired, the bottom and cover components of the enclosures can be secured to one another, such as by adhesive bonding, so as to preclude tampering with the ink supply bag.

Figure 6:
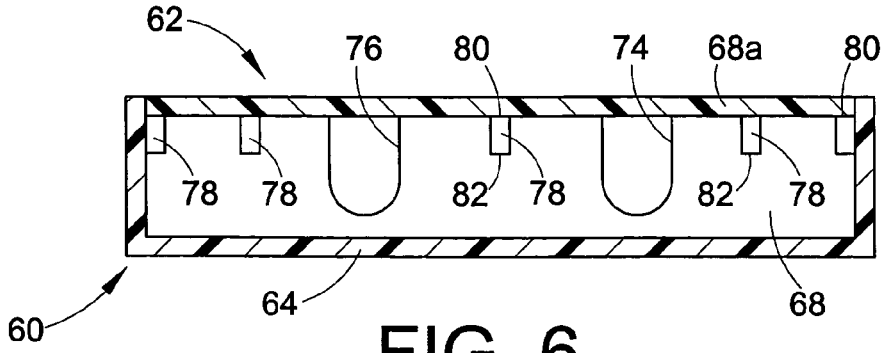
Figure 4:
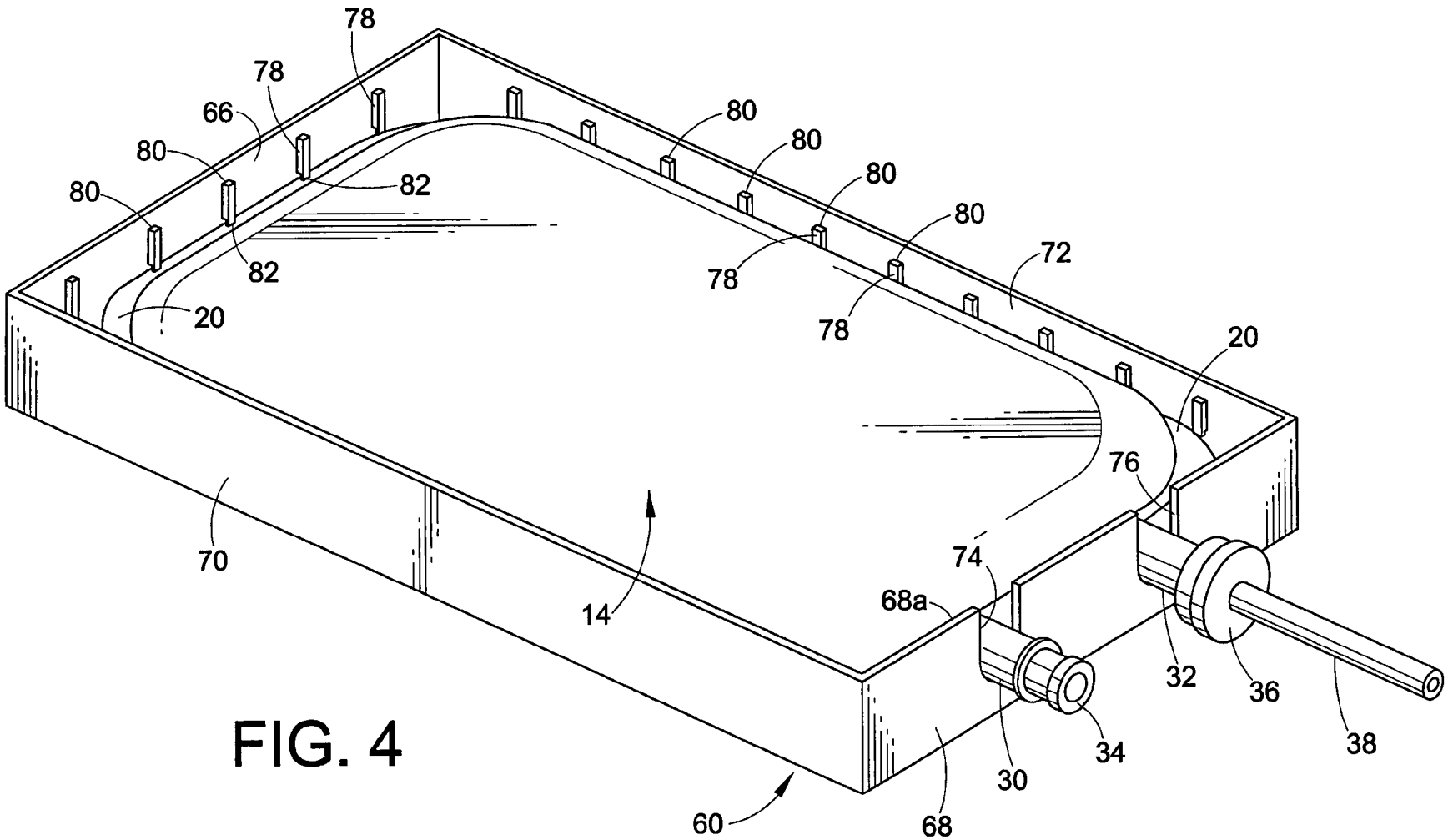
FIG. 4 is a perspective view of another embodiment of the bottom of an enclosure with an ink reservoir bag therein.
Figure 5:
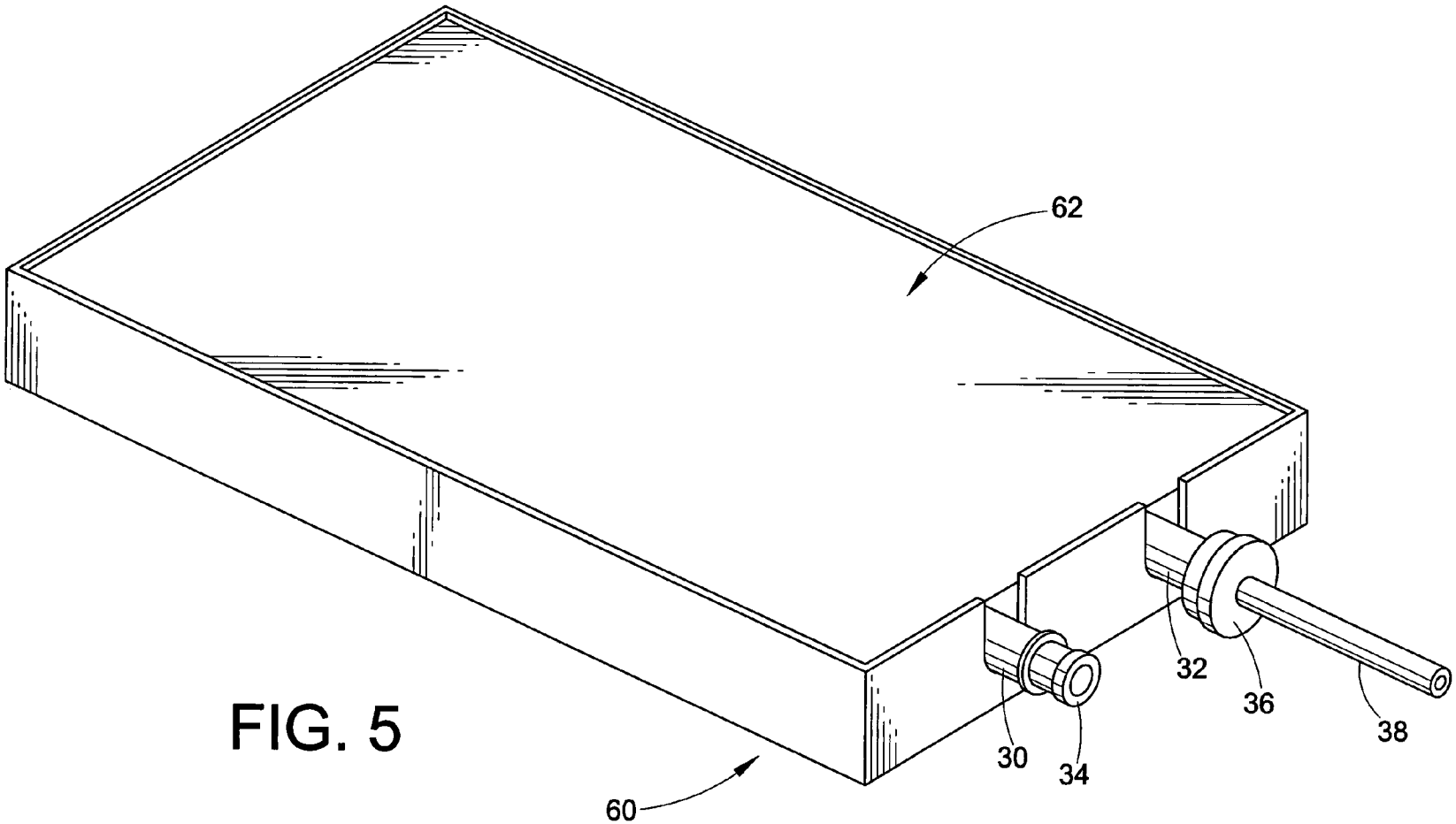
FIG. 5 is a perspective view of the bottom shown in FIG. 4 and a cover thereon to provide an enclosure for the bag; and, FIG. 6 is a cross-sectional elevation view of the assembled bottom and cover component shown in FIG. 5.

FIGS. 4-6 illustrate another embodiment of an ink reservoir bag enclosure in accordance with the invention. In this embodiment, the reservoir bag 14 is as described hereinabove in connection with FIGS. 1-3, whereby like numerals are used in association therewith in FIGS. 4 and 5. The enclosure in this embodiment is rectangular to accommodate the same ink supply bag dimensions as in the earlier embodiment and comprises a bottom 60 in the form of a tray of plastic material and a planar cover 62 of plastic material. Bottom 60 has a planar bottom wall 64, end walls 66 and 68 integral with and extending upwardly from the bottom wall and side walls 70 and 72 integral with and extending upwardly from the bottom wall between the end walls and integral with the latter at the corners therebetween. End wall 68 is provided with U-shaped recesses 74 and 76 extending thereinto from the upper edge 68*a* thereof for accommodating fill and exit ports 30 and 32, respectively. The inner sides of each of the end walls and side walls is provided with a plurality of ribs 78 spaced apart along the length thereof and each of which has an upper end 80 spaced below the upper edge of the corresponding wall a distance generally equal to the thickness of cover 62. Further, each of the ribs has a lower end 82 spaced above bottom wall 64 so as to engage over peripheral edge 20 of the ink supply bag 14 when the latter is seated in bottom 60. When the bag is placed in bottom 60 as shown in FIG. 4, cover 62 is positioned to overlie the bag with the peripheral edges of the cover supported by the upper ends 80 of ribs 78. Preferably, cover 62 is sealingly engaged with bottom 60, such as by adhesive bonding or heat welding, thus to preclude tampering with the ink bag.

While considerable emphasis has been placed herein on preferred embodiments of the invention, it will be appreciated that other embodiments can be devised and that many changes can be made in the preferred embodiments without departing from the principles of the invention. Accordingly, it is to be distinctly understood that the foregoing descriptive matter is to be interpreted merely as illustrative of the invention and not as a limitation, and that it is intended to include other embodiments and all modifications of the preferred embodiments insofar as they come within the scope of the appended claims or the equivalents thereof.

Having thus described the invention, it is so claimed:

1. An enclosure for an ink reservoir bag in an ink delivery system for an ink cartridge, said enclosure comprising a tray and a cover for said tray, said tray including a bottom wall having opposite ends and opposite sides, end walls extending upwardly from said bottom wall at said opposite ends, side walls extending upwardly from said bottom wall along said opposite sides, and one of said end walls of said tray having at least one opening therethrough between said side walls, wherein said end walls and side walls of said tray each has inner surfaces provided with a plurality of supports extending inwardly from each of said inner surfaces, said supports of each corresponding wall each has an upper end spaced below an upper edge of said corresponding wall and a lower end spaced above said bottom wall, said upper end of each support engaging and supporting a peripheral edge of said cover and said lower end of each support engaging a peripheral edge of the ink reservoir bag when the ink reservoir bag is seated in said tray.

2. An enclosure for an ink reservoir bag in an ink delivery system for an ink cartridge, said enclosure comprising a tray and a cover for said tray, said tray including a bottom wall having opposite ends and opposite sides, end walls extending upwardly from said bottom wall at said opposite ends, side walls extending upwardly from said bottom wall along said opposite sides, and one of said end walls of said tray having at least one opening therethrough between said side walls, wherein said end walls and side walls of said tray have inner surfaces provided with a plurality of ribs spaced apart along a length of each of said inner surfaces, said ribs of each corresponding wall each has an upper end spaced below an upper edge of said corresponding wall and a lower end spaced above said bottom wall, said lower end engaging a peripheral edge of said ink reservoir bag when the ink reservoir bag is seated in said tray, wherein said cover is configured to overlie the ink reservoir bag with peripheral edges of said cover being supported by said upper ends of said ribs of each corresponding wall.

3. An enclosure according to claim 2, wherein said one of said end walls of said tray has an edge spaced from and parallel to said bottom wall, said at least one opening in said one of said end walls of said tray being U-shaped and extending from said edge toward said bottom wall.

4. An enclosure according to claim 2, wherein said cover includes a top wall having opposite ends and opposite sides, end walls extending downwardly from said top wall at said opposite ends thereof, side walls extending downwardly from said top wall along said opposite sides thereof, one of said end walls of said cover overlying said one of said end walls of said tray and having at least one opening therethrough in alignment with said at least one opening in said one of said end walls of said tray.

5. An enclosure according to claim 2, wherein said upper end of each of said ribs is spaced below the upper edge of each corresponding wall a distance generally equal to the thickness of said cover.

6. An enclosure according to claim 4, wherein said one of said end walls of said cover has an edge spaced from and parallel to said top wall, said at least one opening in said one of said end walls of said cover being U-shaped and extending from said edge toward said top wall.

* * * * *